United States Patent [19]

van Druff, Jr. et al.

[11] Patent Number: 5,009,366

[45] Date of Patent: Apr. 23, 1991

[54] MAILBOX INSERT

[75] Inventors: Albert van Druff, Jr., Lawrenceville; David A. Fussell, Lilburn, both of Ga.

[73] Assignee: Cornerstone Products Inc., Norcross, Ga.

[21] Appl. No.: 480,951

[22] Filed: Feb. 16, 1990

[51] Int. Cl.[5] ..... V65D 91/00

[52] U.S. Cl. ..... 232/17

[58] Field of Search ..... 232/17; 229/193, 194

[56] References Cited

U.S. PATENT DOCUMENTS

| | | | |
|---|---|---|---|
| 2,731,191 | 1/1956 | Layne | 229/193 X |
| 4,121,758 | 10/1978 | Bonner | 232/17 |
| 4,160,520 | 7/1979 | Cluthe | 232/17 |
| 4,714,192 | 12/1987 | Harlow et al. | 232/17 |
| 4,753,385 | 6/1988 | Phipps et al. | 232/17 |
| 4,896,827 | 1/1990 | Economou | 232/17 |

*Primary Examiner*—Robert W. Gibson, Jr.

*Attorney, Agent, or Firm*—N. J. Aquilino

[57] ABSTRACT

A tray-type mailbox insert for use in delivering and removing mail from a mailbox formed of a foldable blank including a bottom panel, side panels, and an end panel and having locking panels and locking tabs to secure the insert in a tray-like configuration.

3 Claims, 2 Drawing Sheets

MAILBOX INSERT

BACKGROUND OF THE INVENTION

The present invention relates to a mailbox insert to fit into conventional mailboxes to facilitate removal of delivered mail from the box.

Many citizens in this country have mail delivered to mailboxes remote from their home, usually located adjacent a nearby main thoroughfare. Mailboxes used are commonly mounted on poles or other suitable supports, and are generally formed of elongated, longitudinal containers having a hinged door which opens at one end thereof for delivering and removing articles of mail. In these types of boxes, removing mail often becomes difficult particularly if thin pieces of mail such as letters or postcards are placed on the bottom near the interior end of the box.

Various mailbox inserts are known in the prior art to facilitate removal of mail from mailboxes, for example, U.S. Pat. Nos. 4,600,143 and 4,714,192 to Harlow et al, 4,362,267 to Donaldson, 2,868,444 to Whittier and 4,753,385 to Phipps et al, among others.

The present invention relates to a mailbox insert formed from a single blank of heavy duty paper, cardboard or similar laminated stock material. The blank is structured to be folded forming a bottom support surface, side walls, end wall, and a suitable locking structure which maintains the insert assembled. The insert also includes an abutment surface for preventing the insert from being completely pulled out of the box as mail is being removed.

Among the objects of the present invention are the provision of a simple, inexpensive mailbox insert which can be formed from a single, flat stock material blank to facilitate removal of mail from the interior of mailboxes.

DESCRIPTION OF THE PREFERRED EMBODIMENTS

Figure 1:
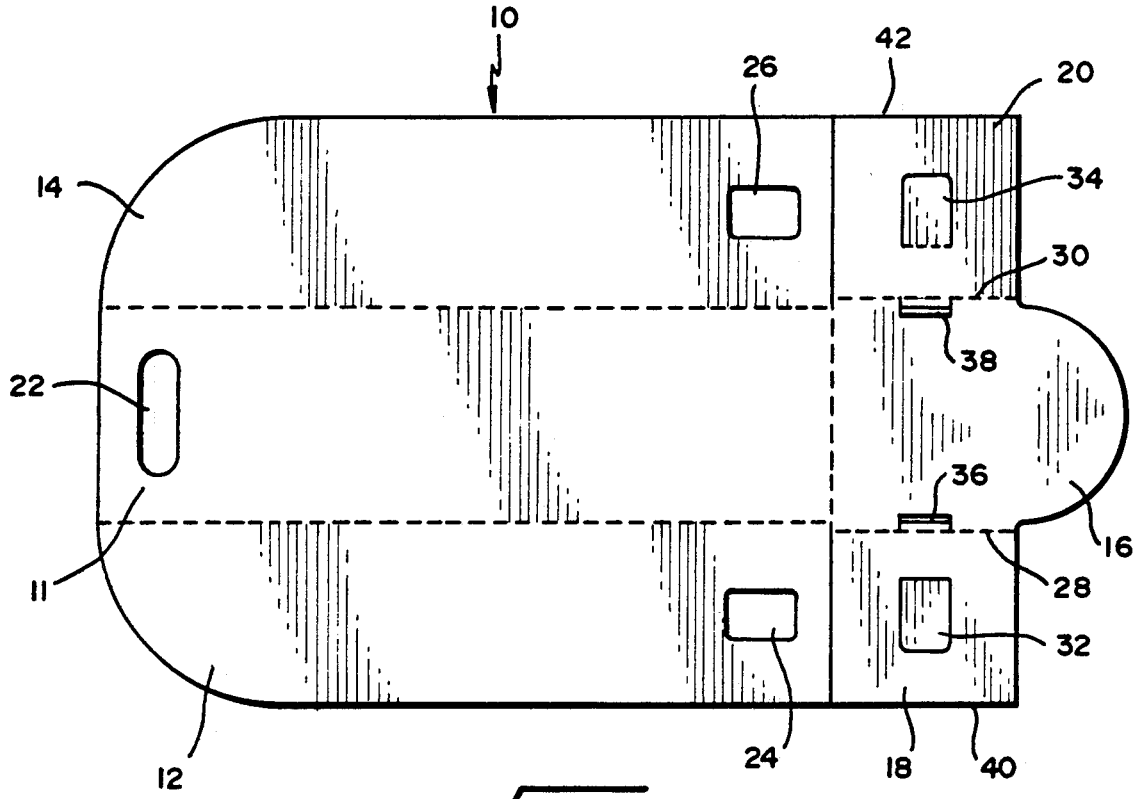
FIG. 1 shows a mailbox insert blank made from flat stock material.

Referring to the drawings, a mail insert box blank 10 includes a bottom panel 11, right hand side panel 12 and left hand side panel 14, end panel 16, right hand locking panel 18 and left hand locking panel 20. The bottom panel 11 includes a finger opening 22 which facilitates removing the mail from the box as described hereinbelow. Side panels 12 and 14 are each provided with locking tab openings 24 and 26, respectively. The locking panels 18 and 20 are connected to the end panel 16 by living hinges 28 and 30. Locking tabs 32 and 34 are provided in each of the locking panels 18 and 20. The end panel 16 is also provided with locking tab detents 36 and 38 offset from the living hinges 28 and 30, and in-line with the locking tabs 32 and 34, as shown. The ends of the locking panels 18 and 20 form abutment surfaces 40 and 42 which prevent the insert from being pulled free from the mailbox as described hereinbelow.

Figure 2:
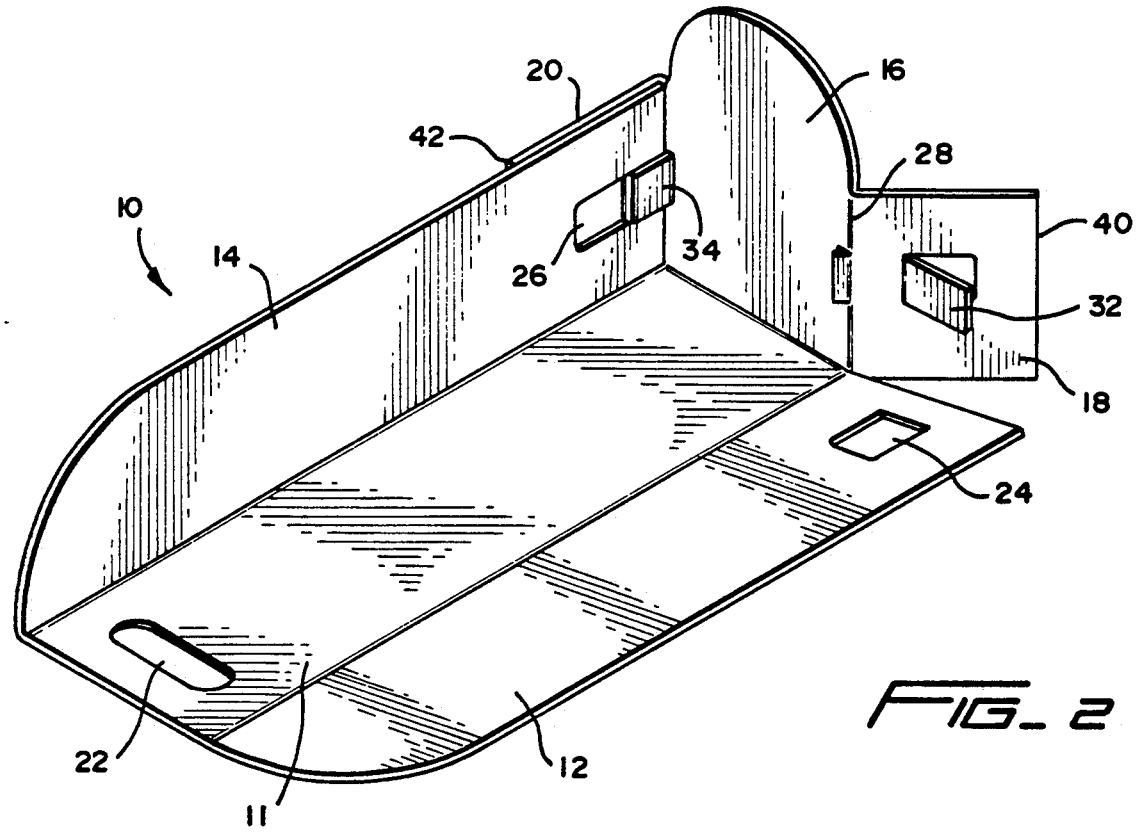
FIG. 2 shows the insert of FIG. 1 in a partially assembled condition.
Figure 3:
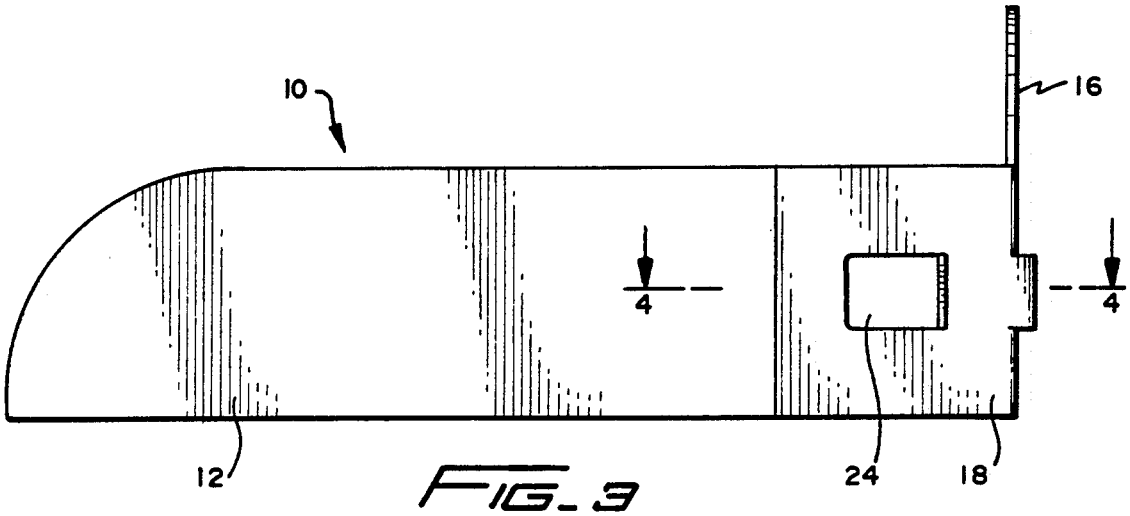
FIG. 3 shows a side elevational view of the assembled insert of FIG. 1.
Figure 4:
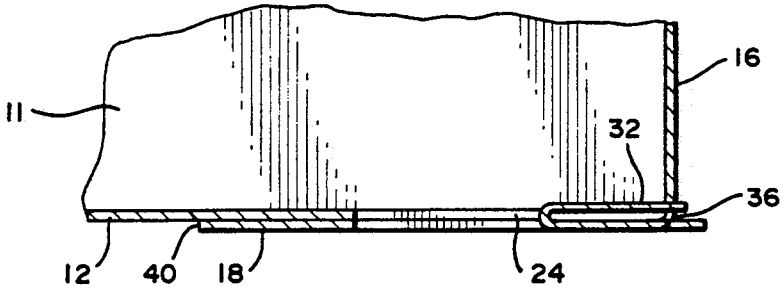
FIG. 4 shows a detail of the tab locking device to assemble the insert, partially in section taken along the lines 4—4 of FIG. 3.

Referring to FIG. 2, which shows a partially assembled insert 10, it can be seen that the side panel and 14 is folded upwardly with respect to the bottom panel 11 at a 90 degree angle. The end panel 16 is also folded upwardly to form a 90 degree relationship to the bottom panel 11. As seen in the drawing, the locking tab 34 on the locking panel 18 has been folded through the locking tab opening 26, and secured in the tab locking detent 38. With normal use of the insert, the connection formed by the locking tabs is secure. It will be appreciated that the opposite side panel 12 and locking panel 18 are secured in the same manner.

Figure 5:
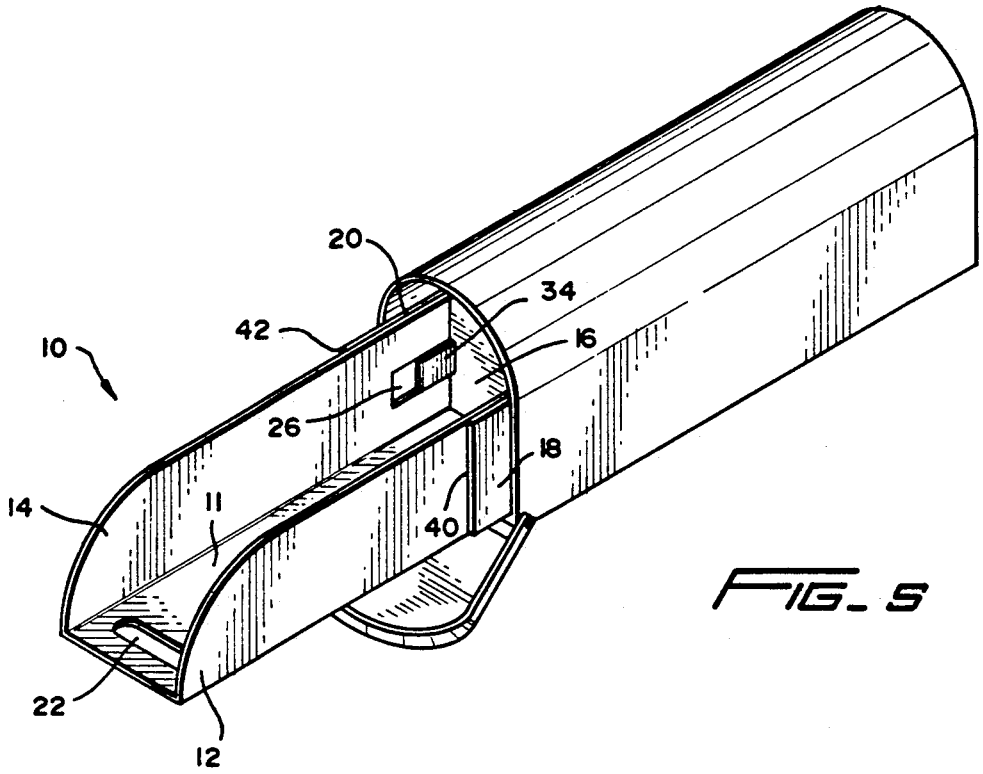
FIG. 5 shows a fully assembled insert in use in a mailbox partially in section.

Referring to FIG. 5, the mailbox insert 10 is shown in use for removing or inserting mail from or into the interior of a mailbox. By grasping the bottom panel by the finger opening 22, the insert 10 can be pulled forwardly and/or reinserted, carrying the mail with it. The abutment surfaces 40 and 42 on the locking panels 18 and 20 engage the interior rolled edge along the mailbox door opening preventing the insert from being completely removed from the box. When mail is in the insert, it is simply removed from the bottom of the insert, and the insert is placed back into the interior of the box for the next delivery.

It will be appreciated that many modifications may be made in the above insert structure in keeping within the scope of the invention as defined in the following claims.

I claim:

1. A tray-type insert for use with a mailbox in delivering and removing mail from the box, said insert being movable between a retracted position within the box and a protracted position partially removed from the box comprising:

a rectangular shaped bottom panel;

side panels generally rectangular in shape and foldably attached to longitudinal edges of said bottom panel; said side panels including locking tab openings at one end thereof;

an end panel foldably attached to an end of said bottom panel;

said bottom panel, side panels and end panel forming a mail receiving chamber;

locking panels having hinge means for attachment to said end panel, said locking panels being positioned on said side panels outwardly of said mail receiving chamber;

locking tab detents formed at a juncture of said end panel and each of said side panels;

locking tabs integrally formed on said locking panels an positioned; opposite said side panel openings, said locking tabs being folded through said side panel openings and lockingly positioned in said locking tab detents tab detents securing said side panels to said end panel; and said locking panels further including an abutment surface formed by an edge of said locking panels to abut a cooperating edge of the mailbox door opening preventing total removal of said insert from the interior of said mailbox when the insert is in the protracted position.

2. The insert of claim 1 further including a finger opening in said bottom panel to facilitate moving said insert between the retracted and protracted positions.

3. The insert of claim 1 wherein said hinge means is formed by a living hinge between an edge of said locking panel and an edge of said end panel.

* * * * *